US007953332B2

(12) United States Patent
Jeschonek

(10) Patent No.: US 7,953,332 B2
(45) Date of Patent: May 31, 2011

(54) METHOD FOR REGULATION OF THE OPTICAL DENSITY IN AN ELECTROGRAPHIC PRINTING METHOD AS WELL AS A TONER LAYER THICKNESS MEASUREMENT SYSTEM AND ELECTROGRAPHIC PRINTER OR COPIER

(75) Inventor: Markus Jeschonek, Erding (DE)

(73) Assignee: Oce Printing Systems GmbH, Poing (DE)

( * ) Notice: Subject to any disclaimer, the term of this patent is extended or adjusted under 35 U.S.C. 154(b) by 620 days.

(21) Appl. No.: 11/938,905

(22) Filed: Nov. 13, 2007

(65) Prior Publication Data

US 2008/0112716 A1 May 15, 2008

(30) Foreign Application Priority Data

Nov. 14, 2006 (DE) ..... 10 2006 053 843

(51) Int. Cl.
*G03G 15/00* (2006.01)

(52) U.S. Cl. ..... 399/44

(58) Field of Classification Search ..... 399/44, 399/49, 94, 97, 60; 324/658
See application file for complete search history.

(56) References Cited

U.S. PATENT DOCUMENTS

| | | | | |
|---|---|---|---|---|
| 5,305,057 | A | 4/1994 | Hattori et al. | |
| 6,201,941 | B1 * | 3/2001 | Kasahara et al. | 399/258 |
| 6,353,716 | B1 | 3/2002 | Uehara et al. | |
| 6,463,226 | B2 | 10/2002 | Kitajima et al. | |
| 6,744,994 | B2 * | 6/2004 | Yoshikawa et al. | 399/44 |
| 6,771,913 | B2 | 8/2004 | Jeschonek et al. | |
| 2003/0091355 | A1 | 5/2003 | Jeschonek et al. | |
| 2003/1750048 | | 9/2003 | Berg et al. | |
| 2006/0018674 | A1 | 1/2006 | Hirata et al. | |
| 2006/0024101 | A1 | 2/2006 | Schoch et al. | |
| 2006/0152775 | A1 | 7/2006 | Itoyama et al. | |

FOREIGN PATENT DOCUMENTS

| | | |
|---|---|---|
| DE | 101 51 702 | 5/2003 |
| DE | 101 51 703 | 5/2003 |
| DE | 102 23 231 | 12/2003 |
| WO | WO 03/100530 | 12/2003 |

* cited by examiner

*Primary Examiner* — David P Porta
*Assistant Examiner* — Faye Boosalis
(74) *Attorney, Agent, or Firm* — Schiff Hardin LLP

(57) ABSTRACT

In a method or system for regulation of optical density in an electrographic printing method, a toner layer thickness of a toner image developed with a developer station is scanned with a sensor. The resulting toner layer thickness signal is used for regulation of inking in the developer station. A humidity is measured with a moisture sensor and the resulting humidity signal is used for at least one of compensation of moisture-dependent deviations of the toner layer thickness signal and regulation of the inking in the developer station.

16 Claims, 7 Drawing Sheets

METHOD FOR REGULATION OF THE OPTICAL DENSITY IN AN ELECTROGRAPHIC PRINTING METHOD AS WELL AS A TONER LAYER THICKNESS MEASUREMENT SYSTEM AND ELECTROGRAPHIC PRINTER OR COPIER

BACKGROUND

The preferred embodiment concerns a method for regulation of the optical density in an electrographic printing method as well as a toner layer thickness measurement system in an electrographic printer or copier.

In electrographic printing methods (which, for example, comprise electrophotographic, magnetographic or also ionographic printing methods), to achieve a desired optical density it is necessary to effect a specific layer thickness of the toner accumulated on the recording carrier material in the developing process.

Given printing with only one color, in particular given printing with black toner, a desired optical density can be achieved in a relatively trouble-free manner due to the strongly opaque character of black. However, given multicolor printing it is very important for a correct color reproduction that the individual colors correspond exactly to a predetermined optical density.

Density measurement sensors can be provided for measurement and regulation of the optical density in an electrographic printing apparatus. For example, measurement arrangements based on a capacitive principle with which the toner layer thickness of electrographically developed toner images or toner layers can be measured for this purpose are known from DE 101 51 702 A1 and from US 2003/0091355 A1.

An electrographic printing or copying apparatus in which a developer station is supplied with fluidized toner via a negative pressure system is known from WO 03/100520.

A printing apparatus in which a temperature and moisture sensor is provided and in which image recording parameters are corrected when the measured values lie outside of predetermined values is known from U.S. Pat. No. 6,463,226 B2.

Further printing apparatuses with a moisture sensor are known from U.S. Pat. No. 6,353,716 and US 2006/0152775 A1. An electrophotographic printing system with a device for estimation of the toner density in a developer mixture is known from US 2006/0018674 A1.

An electrographic printing apparatus in which the latent image is developed with fluid toner is known from US 2003/0175048 A1.

The aforementioned publications are herewith incorporated by reference into the present specification.

SUMMARY

It is an object to specify measures for precise measurement of optical density of an electrographically developed image.

In a method or system for regulation of optical density in an electrographic printing method, a toner layer thickness of a toner image developed with a developer station is scanned with a sensor. The resulting toner layer thickness signal is used for regulation of inking in the developer station. A humidity is measured with a moisture sensor and the resulting humidity signal is used for at least one of compensation of moisture-dependent deviations of the toner layer thickness signal and regulation of the inking in the developer station.

DESCRIPTION OF THE PREFERRED EMBODIMENT

Figure 1:
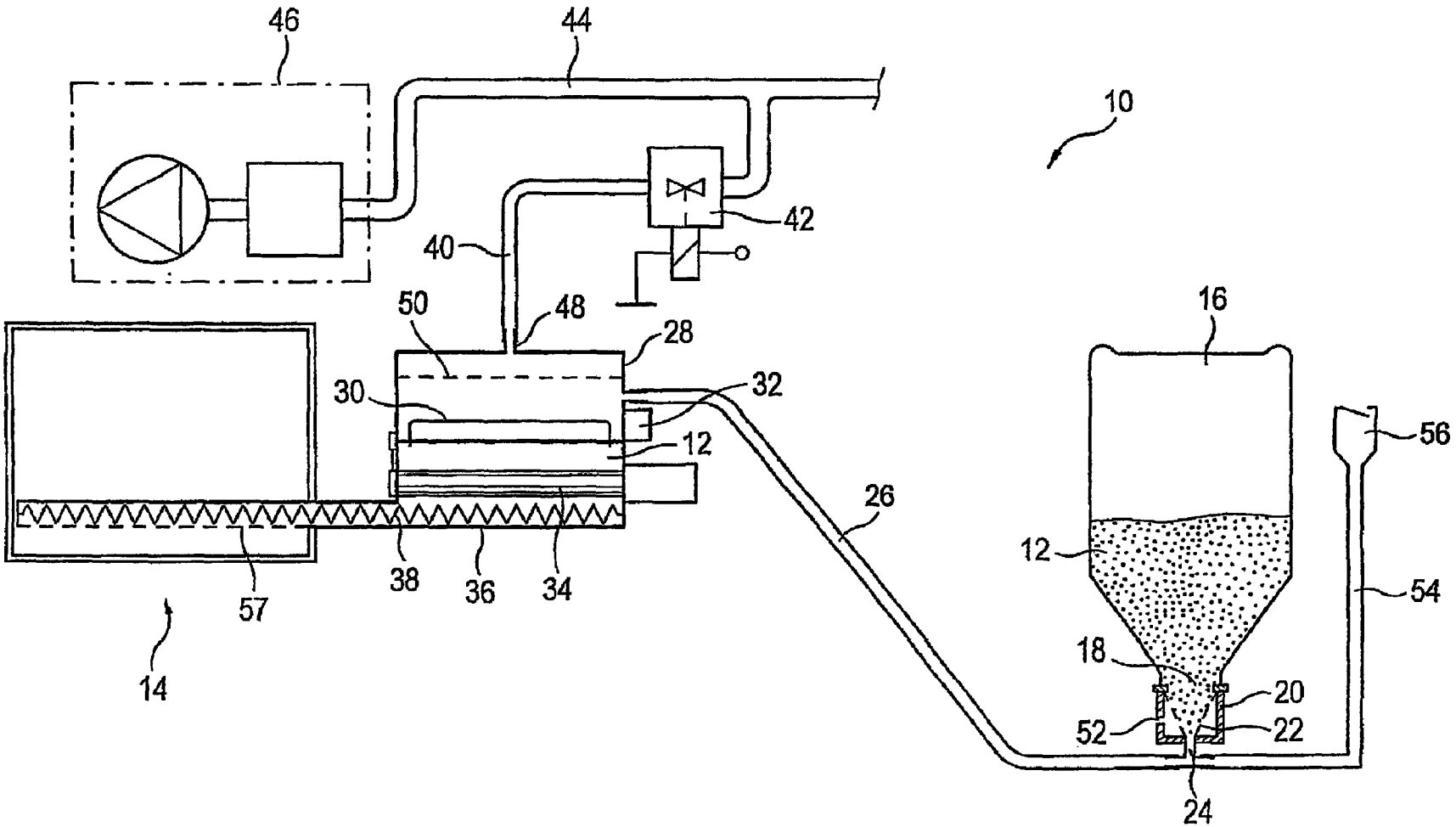
FIG. 1 shows a toner supply unit.

For the purposes of promoting an understanding of the principles of the invention, reference will now be made to the preferred embodiment/best mode illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

According to the preferred embodiment, the toner layer thickness of a toner image developed with a developer station is scanned with a capacitive sensor. The humidity is additionally measured with a moisture sensor and the humidity signal is used for compensation of moisture-dependent deviations of the toner layer thickness signal and/or for regulation of the inking in the developer station.

The preferred embodiment is based on the realization that the measurement signal of a capacitive toner layer thickness sensor is dependent not only on the toner layer thickness but rather also significantly on the quantity of water molecules accumulated on the surface of the layer thickness. The water molecules have a significantly higher dielectricity constant than the toner and therefore lead to a significantly altered measurement signal.

The preferred embodiment is furthermore based on the realization that, for the accumulation of water molecules in the toner in an electrographic printing method or electrographic printing apparatus, it is advantageously examined in which regions in which toner is transported or otherwise mechanically processed (in particular is stirred) the toner can absorb water molecules. Via the provision of a humidity sensor in such a region it can be determined what water quantity has accumulated in the toner, and with this the later, capacitively measured toner layer thickness signal or, respectively, the corresponding value can be corrected in an analog or digital manner. This in particular applies when there are one or more regions in which the toner can absorb a particularly large amount of water, for example in particularly damp or particularly warm regions of a printing system.

According to an advantageous exemplary embodiment it is provided to implement the moisture measurement at a point in time of the printing process and/or in a region of the printing apparatus in which the toner absorbs moisture particularly well or absorbs a particularly large amount of moisture. It has thereby turned out that this region is not necessarily identical with the region in which the density sensor is located, meaning that (contrary to initial assumptions) the moisture measurement is not reasonable in the region of the density sensor but rather in another region of the printing apparatus remote from the density sensor. It has in particular been shown that the moisture measurement advantageously occurs in a region in which toner is stirred with surrounding air, i.e. in a toner reservoir region, a toner transport region or a toner mixing region.

It has in particular been shown that the toner absorbs a particularly large amount of moisture in a printing system in which toner is fluidized with air and is transported into a developer station via an air pressure system. The humidity is then advantageously measured in a region representative of the toner transport or in a region in which the air is streamed in or admixed with the toner; it was then detected that the moisture accumulating in the toner in such a system significantly accumulates in the toner during the fluidization.

The moisture measurement in particular occurs at a point in time before the toner passes through the development process while the capacitive toner density measurement only occurs after the development process.

The preferred embodiment advantageously enables electrographic printing or copying apparatuses to be operated without climate control, in particular without interior climate control and without climate control in the space surrounding the printer. With the preferred embodiment this can be achieved without having to accept a print quality loss or severe fluctuations in the optical density of the print image. Without climate control such printing processes (in particular in high-capacity printing) can be implemented in a more cost-effective manner.

The scanning of the toner image can occur on an intermediate image carrier (such as a photoconductor drum, a photoconductor belt) or on a transfer element (in particular a transfer belt) momentarily accommodating the toner image, which transfer element is arranged between a photoconductor and a recording medium ultimately carrying the image. The scanning of the toner image or of the toner layer in particular occurs before a process fixing the toner image, in particular before a thermo-printing fixing process, a cold fixing process based on a flash exposure, or another fixing process. The toner image can comprise productively used images or test images (in particular toner markings) that are specifically generated for regulation of the development process.

In a preferred exemplary embodiment, the measured humidity is already used in the sensor arrangement for compensation of climate influences of the capacitive sensor signal. Alternatively or additionally, the humidity signal can be used for regulation of the inking in a regulation unit of the developer station or of the printing apparatus.

In a further preferred exemplary embodiment, a temperature sensor is additionally provided with which the temperature is measured in the same region of the printing process as the moisture, and the temperature signal is likewise used for regulation of the inking in the developer station. Temperature measurement and/or humidity measurement can occur at points of the printing process or printing apparatus that, depending on the printing apparatus, are representative of the moisture absorption of the toner. For example, this could be the region of a toner transport or the development process in the developer station itself or also a reservoir chamber in the developer station in which the toner is stirred for its triboelectric charging.

The temperature sensor and the moisture sensor can be designed as a common, combined climate sensor. A signal for the relative humidity can be emitted as a moisture signal and the absolute humidity at the measurement location can be determined from this signal and the temperature signal. The subsequent corrections to the toner layer thickness signal and/or to the inking regulation can then occur using the absolute humidity.

A correction value for the toner layer thickness signal can be formed on the basis of the moisture signal and the corrected toner layer thickness signal can be used for regulation of the inking. The correction value K can be determined according to the following formula:

$$K=a\times e^{b\times H}+c,$$

whereby a, b and c are empirical values dependent on the employed toner, e is the Euler number and H is the absolute humidity.

In a further advantageous exemplary embodiment of the invention, the moisture signal and/or the temperature signal are used for activation or regulation of further method components of the printing process. For example, such components can be the developer station or its corotron voltages, corotron currents, concentration sensors or concentration regulations or also the fixing station.

Temperature measurement and moisture measurement can occur with known methods and sensors. An averaging can be provided to improve the measurement values.

According to the preferred embodiment, a corresponding measurement system and a corresponding printer or copier are also provided.

A toner transport system 10 of a printer or copier is shown in FIG. 1. The toner transport system 10 serves to feed toner material 12 into a developer station 14. The toner material 12 is fed to a developer station 14 of a printer or copier (not shown) from a reservoir container 16 in which the toner material 12 is contained. An opening 18 serves for extraction of toner material 12. A sealing device 20 is connected in a toner-proof manner with the toner container 16 such that toner material 12 slides from the reservoir container 16 into the sealing device 20.

The sealing device 20 comprises a hopper or funnel 22 into which the toner material 12 slides from the reservoir container 16. The hopper 22 has a hopper outlet 24 that is connected in an air- and toner-tight manner with a tube system 26. The tube system 26 connects the hopper outlet 24 with a buffer 28 that is arranged in proximity to the developer station 14 and in which toner material 12 is buffered or cached for further transport in the developer station 14. The buffer 28 comprises a stirring hoop 30, a fill level sensor 32 and a dosing device 34 that comprises a bucket wheel. A toner transport tube 36 with a toner transport spiral 38 connects the buffer 28 with the developer station 14 and transports toner material 12 from the buffer 28 to the developer station 14 as needed. The quantity of toner material 12 conveyed into the developer station 14 is adjusted and dosed with the aid of the dosing device 34 and/or the transport tube 36, which are respectively connected with a drive device (not shown).

The stirring hoop 30 stirs the toner material 12 in the buffer 28 to maintain the triboelectric charge of the toner mixture. The buffer 28 is air-tight, whereby the space of the buffer 28 (which space is sealed air-tight) is connected with a central negative pressure line 44 via a tube system 40 that comprises a control valve 42. A negative pressure in the central negative pressure line 44 is generated via a negative pressure blower 46. The tube system 40 is connected with an upper segment of the buffer 28. A filter 50 is arranged below connection point 48 towards the sealed chamber. Below this filter 50 the buffer 28 is connected with the tube system 26. The control valve 42 regulates the negative pressure in the tube system 40 as well as in the buffer 28 connected therewith and in the tube system 26. This negative pressure ensures that toner material 12 is transported from the hopper outlet 24 of the sealing device 20 into the chamber of the buffer 28 via the tube system 26.

The quantity of the conveyed toner material 12 can be adjusted in an analog manner with the aid of the control valve 42 in many positions. However, in other exemplary embodiments the control valve 42 can also be operated in a two-point operation, whereby the conveyed quantity of toner material 12 then depends on the negative pressure in the tube system 44 and the opening time of the control valve 42. Hopper 22 has porous, air-permeable hopper walls. Air is sucked out from the sealing device 20 into the hopper 22 via the negative pressure at the hopper outlet 24. A toner-air mixture which has a fluid-like state (what are known as fluid properties) is thereby generated in the hopper 22. This air that, as described, is drawn into the hopper 22 with the aid of the negative pressure is fed into the sealing device 20 via an opening 52. The air fed through the opening 52 can be controlled via a valve (not shown). The hopper outlet 24 is also connected with a tube system 54 with a control valve 56 via which environment air can be fed to the tube system 26. Furthermore, a return valve (not shown) that prevents an escape of toner material even given disadvantageous pressure ratios in the tube systems 44, 26, 54 is furthermore contained in the control valve 56. The quantity of toner material 12 that is conveyed from the container 16 into the buffer 28 can be regulated via the control valve 56.

The control valves 42 and 56 are electrically actuated valves. The negative pressure ratios in the buffer 28 and in the tube system 26 can be exactly adjusted with the aid of the control valve 42. The toner transport from the reservoir container 16 into the buffer 28 is regulated corresponding to the signal of the fill level sensor 32. As already mentioned, the control valve 42 and the control valve 56 serve as control elements of the regulation. The vacuum air required for toner transport is adjusted via these control valves 42, 56. The toner material 12 escaping from the hopper outlet 24 is carried away by the air current in the tube system 26, 54 and is transported to the buffer 28. The filter 50 in the buffer 28 prevents the further transport of the toner material 12 in the tube system 40.

After the closing of the valve 42 the clean air side of the filter 50 is aerated at environment pressure. A negative pressure relative to the environment pressure in the tube system 40 is thereby at least temporarily in the buffer 28. Given the following pressure compensation between the tube system 40 and the buffer, air flows from the tube system 40 through the filter 50 into the buffer 28. The air flow given this pressure compensation is directed counter to the air flow upon intake of the toner material. Toner material 12 settled on the filter 50 is detached from the filter 50 via the air flow upon pressure compensation and falls into the buffer 28. A potentially possible escape of toner material 12 via the tube system 54 is prevented by the return valve 56. As already mentioned, the toner material 12 is transported from the buffer 28 into the developer station 15 with the aid of a transport tube 36. The transport tube 36 protrudes with one end into the developer station 14 and has wide openings on an underside 57 at this end, through which wide openings the toner material 12 falls from the transport tube 36 into the developer station 14.

The transport spiral 38 contained in the transport tube 36 has an incline such that the toner material 12 in the transport tube 36 is transported from the buffer 28 towards the developer station 14, similar to as in a screw conveyer tube. As already mentioned, the transport spiral 38 is driven with the aid of a drive unit. The dosing device 34 comprises a bucket wheel-like roller that is arranged between the buffer 28 and the transport tube. Such a dosing device 34 is also designated as a cell wheel sluice. The bucket wheel-like roller seals the buffer 28 nearly airtight from the transport tube 36, such that air is sucked from the tube system 26 with the aid of the negative pressure blower 46 upon generation of a negative pressure. The bucket wheel-like roller is advantageously driven synchronously with the transport spiral 38, whereby given a rotation of the bucket wheel-like roller (which is also designated as a cell wheel) toner material falls from the buffer 28 into the bucket chambers or cells and is transported downward to the transport tube 36 via the rotation.

Below the dosing device 34, the transport tube 36 has an opening at the top to the dosing device 34 so that the toner material 12 falls downward from the cells into the transport tube 36. The stirring hoop 30 inside the buffer 28 is driven with the aid of a drive unit (not shown) and, via a rotation, prevents a void formation or cornice formation in the toner material 12 of the buffer 28.

Figure 2:
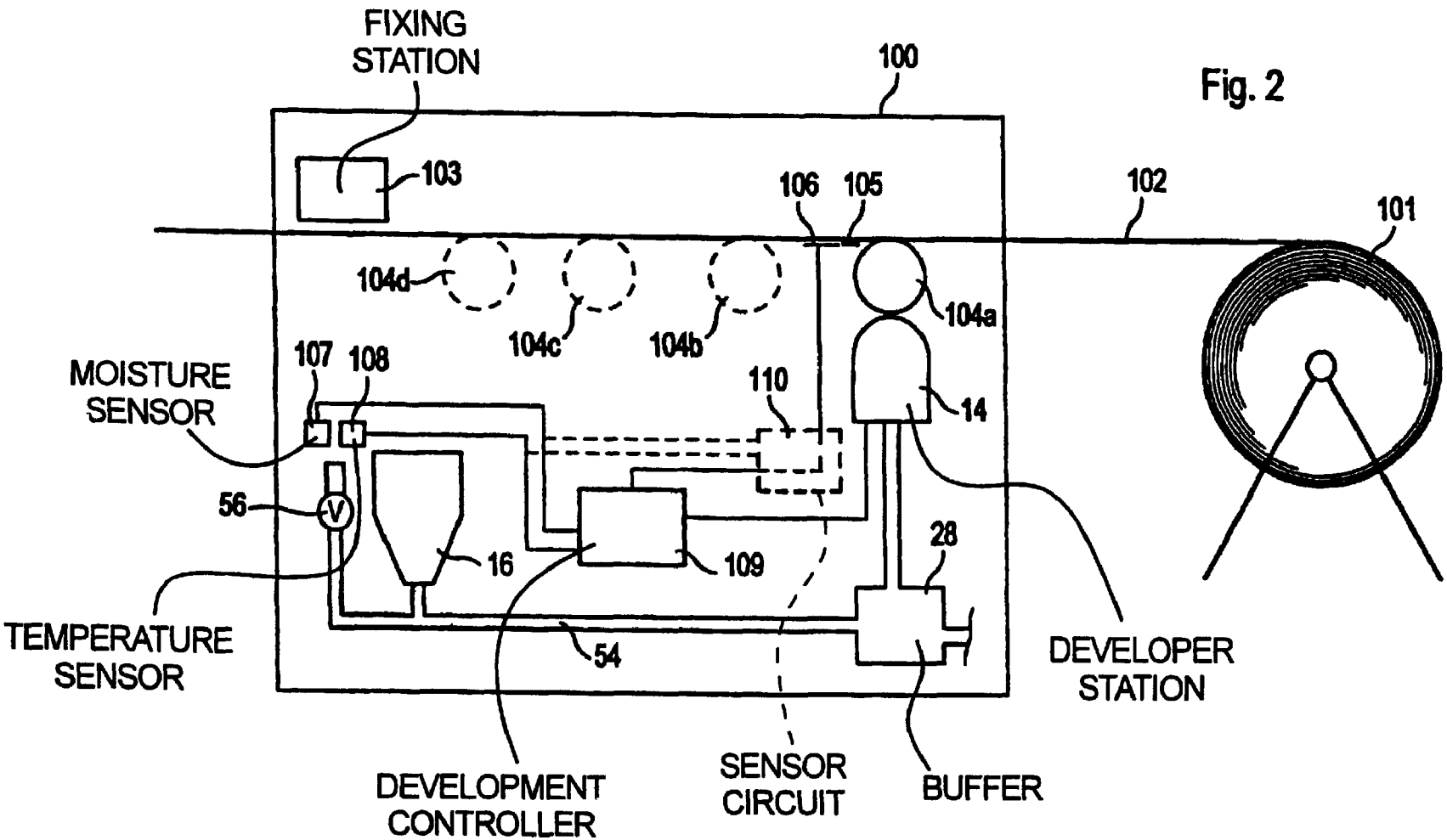
FIG. 2 shows a printing apparatus.

FIG. 2 shows a printing apparatus 100 to which a paper web 102 is fed from a paper roll 101. The printing apparatus 100 comprises four printing stations with corresponding photoconductor drums 104*a*, 104*b*, 104*c* and 104*d* for the colors cyan (C), yellow (Y), magenta (M) and black (K). Each of the color stations comprises a similar toner supply system as it was described in FIG. 1. The corresponding reference characters are also indicated in FIG. 2. The developer station 14 develops a first image, via which a toner layer 105 is formed on the paper web 102. The toner layer thickness sensor 106 scans this toner layer and communicates the signal to the development controller 109 as a toner density signal. The controller 109 simultaneously receives signals of the moisture sensor 107 and the temperature sensor 108 that are both arranged in the intake region of the control valve 56 with which (according to this exemplary embodiment) the entire air that is required for fluidization of the toner in the tube system 54 is drawn in. Both sensors 107, 108 can be provided with dust protection caps in order to protect against toner dust.

Moisture sensor 107 and temperature sensor 108 can in particular be designed as a combined climate measurement apparatus in a common housing, and their measurement values can, for example, also be transferred digitally and/or via a common data connection. The development controller 109 processes the signals of the sensors 106, 107 and 108 and from these forms a compensated toner layer thickness signal that is used for the control variables for inking in the developer station 14. The compensated signal can be determined computationally or by means of look-up tables (LUTs). The control variables for the developer station can thereby also directly arise from corresponding signal values of the sensors and other development parameters using combined formulae and/or look-up tables. As an alternative to the formation of a compensated signal in the sensor controller, the compensated signal can also be formed in a sensor circuit 110 that is connected between the sensor 106 and the development controller 109 and receives and processes the data or signals of the moisture sensor 107 and of the temperature sensor 108 as additional input data.

Figure 3:
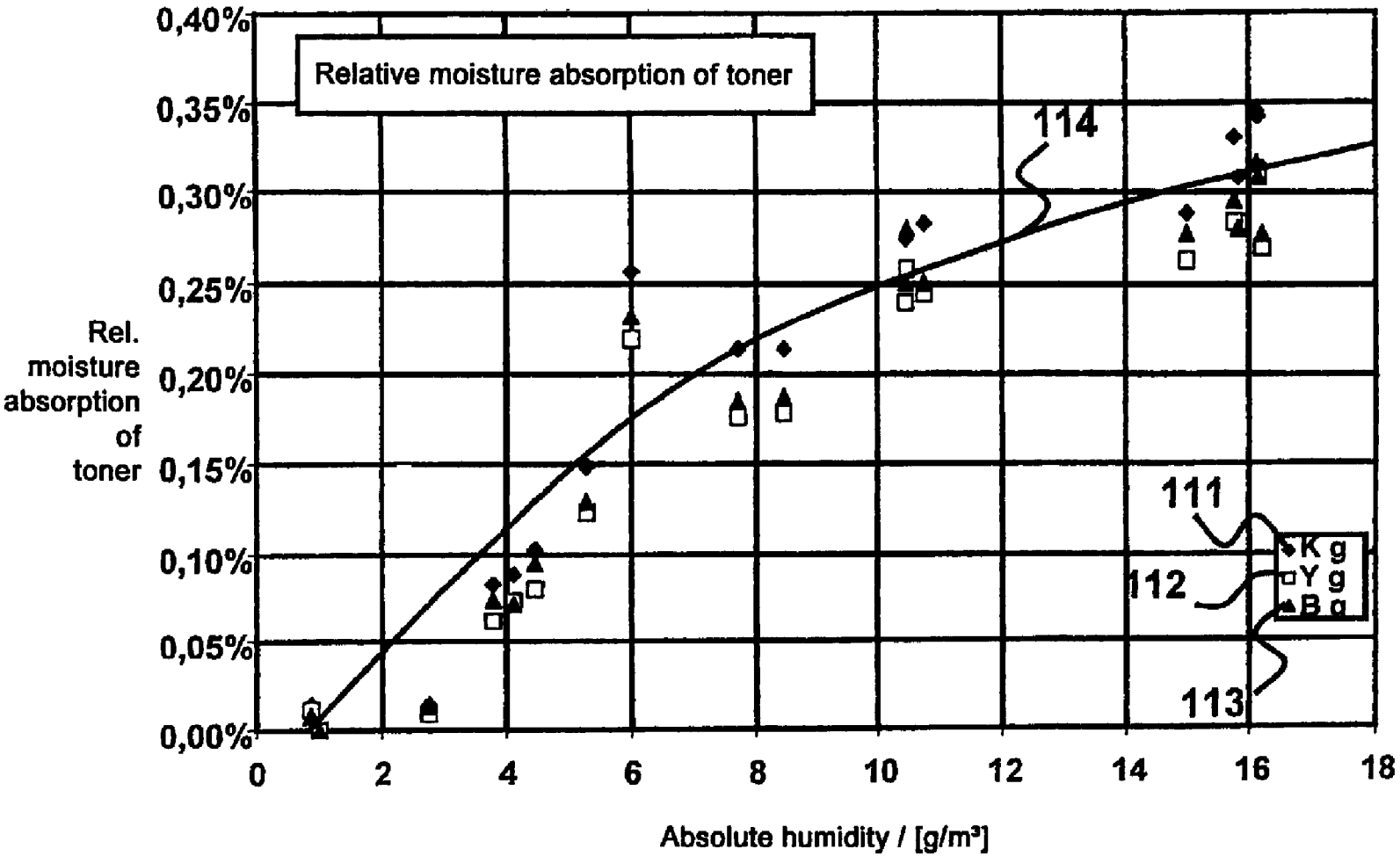
FIG. 3 illustrates a measurement curve for the relative moisture absorption of toner.

FIG. 3 shows measurement values and a typical curve of the relative moisture absorption of various toners over the absolute humidity of the air surrounding the toner. The measurement values depicted as diamonds are values of a black toner, the measurement values depicted as squares are values of a yellow toner and the measurement values depicted as triangles are values of a blue toner. Common to all measurement values is an asymptotic curve that is symbolically represented in FIG. 3 with the curve 114. The dielectricity constant of the toner also changes due to the corresponding moisture absorption of the toner particles. Given a measurement of the toner layer thickness with a capacitive sensor, this has the effect that the sensor signals are different depending on the moisture content of the toner. Due to the fact that the relative dielectricity constant of toner lies in the range of approximately 2.5 and that of water lies in the range of approximately 80 (i.e. more than 30 times higher), slight differences in accumulated water content of the toner can already have a very strong effect on the measurement signals of the capacitive measurement sensor. The asymptotic curve can be represented by a logarithmic function, whereby the relative moisture absorption of the toner goes into saturation with increasing absolute humidity.

The water content in the toner is dependent on the absolute water content of the air. For correction of the sensor signals of the capacitive sensor it is thereby advantageous to detect and use for correction not only the relative humidity but rather also the air temperature. The absolute humidity can then be determined from these two values and the compensation of the toner layer thickness signals of the capacitive sensor can occur with higher precision.

In particular sensors as they are described in the aforementioned DE 101 51 702 A1 or, respectively, US 2003/0091355 can be used as capacitive sensors. For this purpose these publications are again explicitly incorporated at this point of the present specification.

Figure 4:
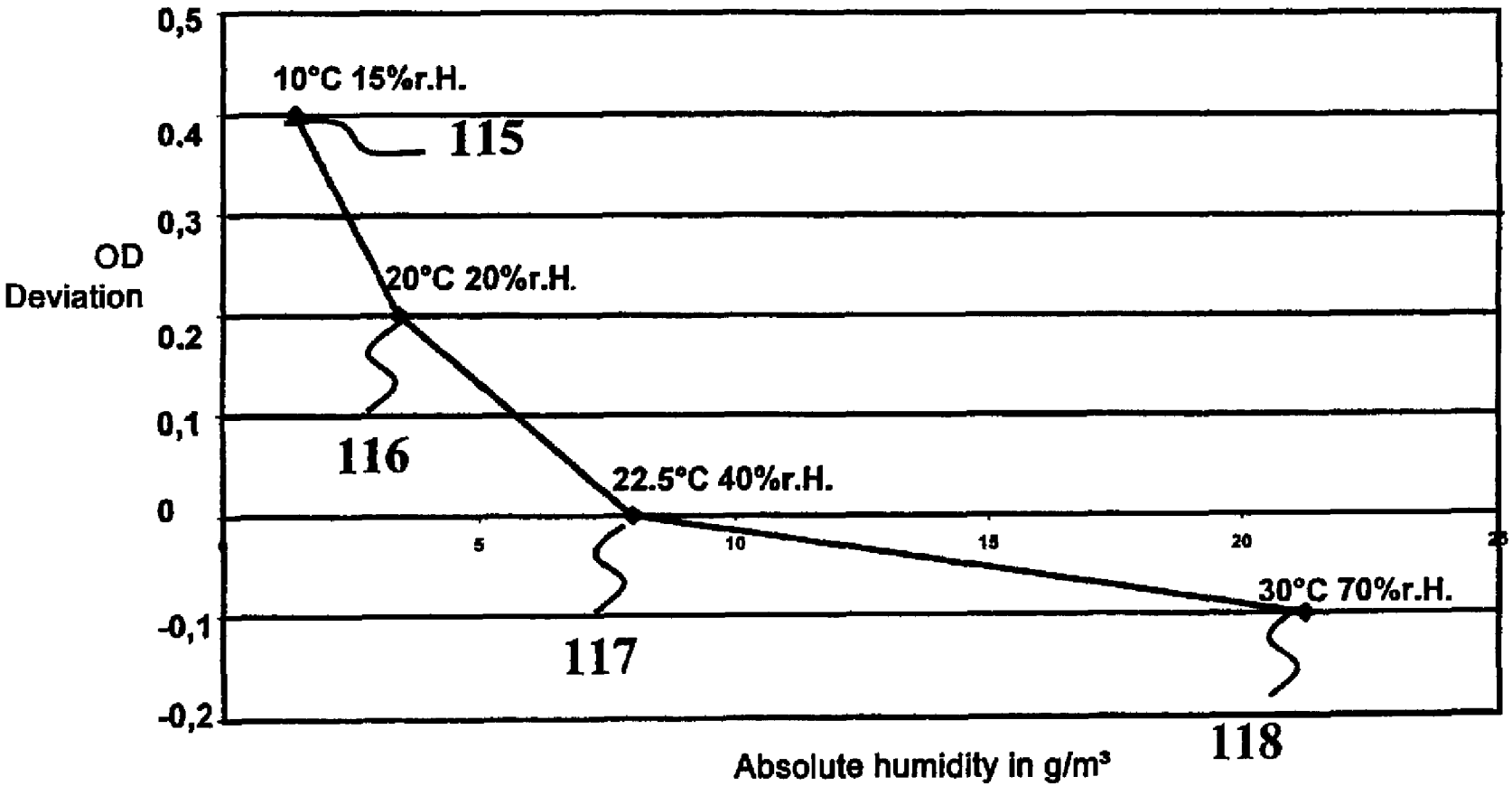
FIG. 4 is a measurement curve for the deviation of the optical density in a print image.

Presented in FIG. 4 is the correlation that results in a printing device for the curve of the deviation of a capacitive measurement signal for the toner layer thickness or the corresponding optical density dependent on the absolute humidity of the air from which the toner significantly absorbs the moisture. The respective measured temperatures and relative humidities are specified at the respective measurement points 115, 116, 117 and 118, for example the temperature 22.5 Celsius and the relative humidity 40% at the measurement point. The corresponding absolute humidities are indicated on the abscissa. For example, it lies at approximately 7.8 grams per cubic centimeter at the measurement point 117. The respective deviations from the actual optical density (OD) are indicated on the ordinate, whereby it is zero at the measurement point 117, +0.4 at the measurement point 115 and −0.1 at the measurement point 118.

Figure 5:
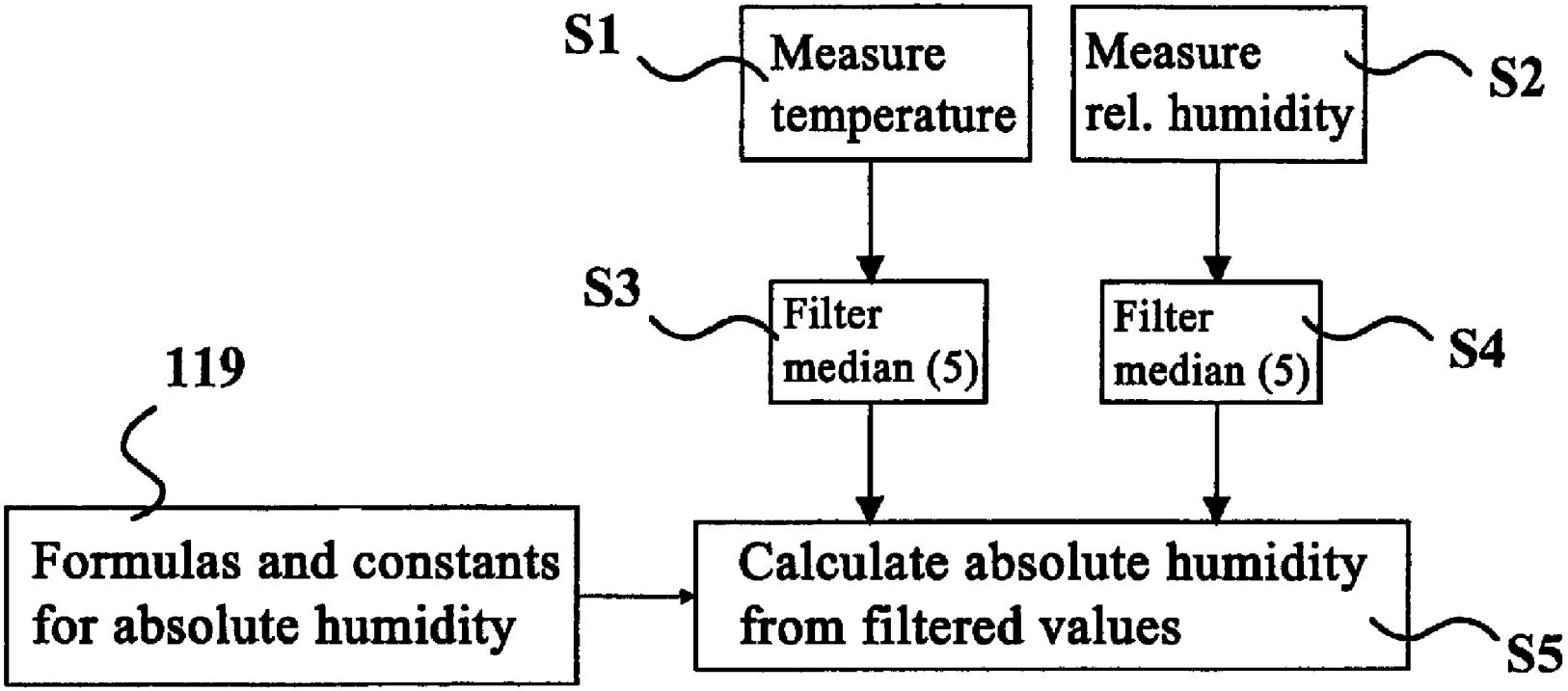
FIG. 5 illustrates a principle for the determination of an absolute humidity value.

FIG. 5 shows a method for evaluation of the values acquired from the temperature sensor and the moisture sensor. The temperature values measured in step S1 are subjected to an averaging (median filtering) in a step S3 and the values measured in a step S2 for the relative humidity are correspondingly subjected to an averaging S4. The average values are then used in step S5 in order to calculate the absolute humidity. Further predetermined formulae and constants are thereby used that are stored in the controller as data sets or conversion parameters 119. The influence of the moisture absorption of the toner and the change of the resulting relative permittivity and consequently the correction of the measured toner mass or toner layer thickness of the capacitive toner mark sensor for the inking regulation are calculated and/or stored in the sensor circuit 110 and/or in the development controller 109 or in a further superordinate control unit in the printing device 100. During the print operation the sensor values are adapted corresponding to a correction rule and/or the inking is regulated towards a different target value corresponding to the measured temperature and moisture. Additionally or alternatively, other inking-relevant parameters (such as, for example, a toner concentration in the developer station) can also be varied relative to a standard value.

Figure 6:
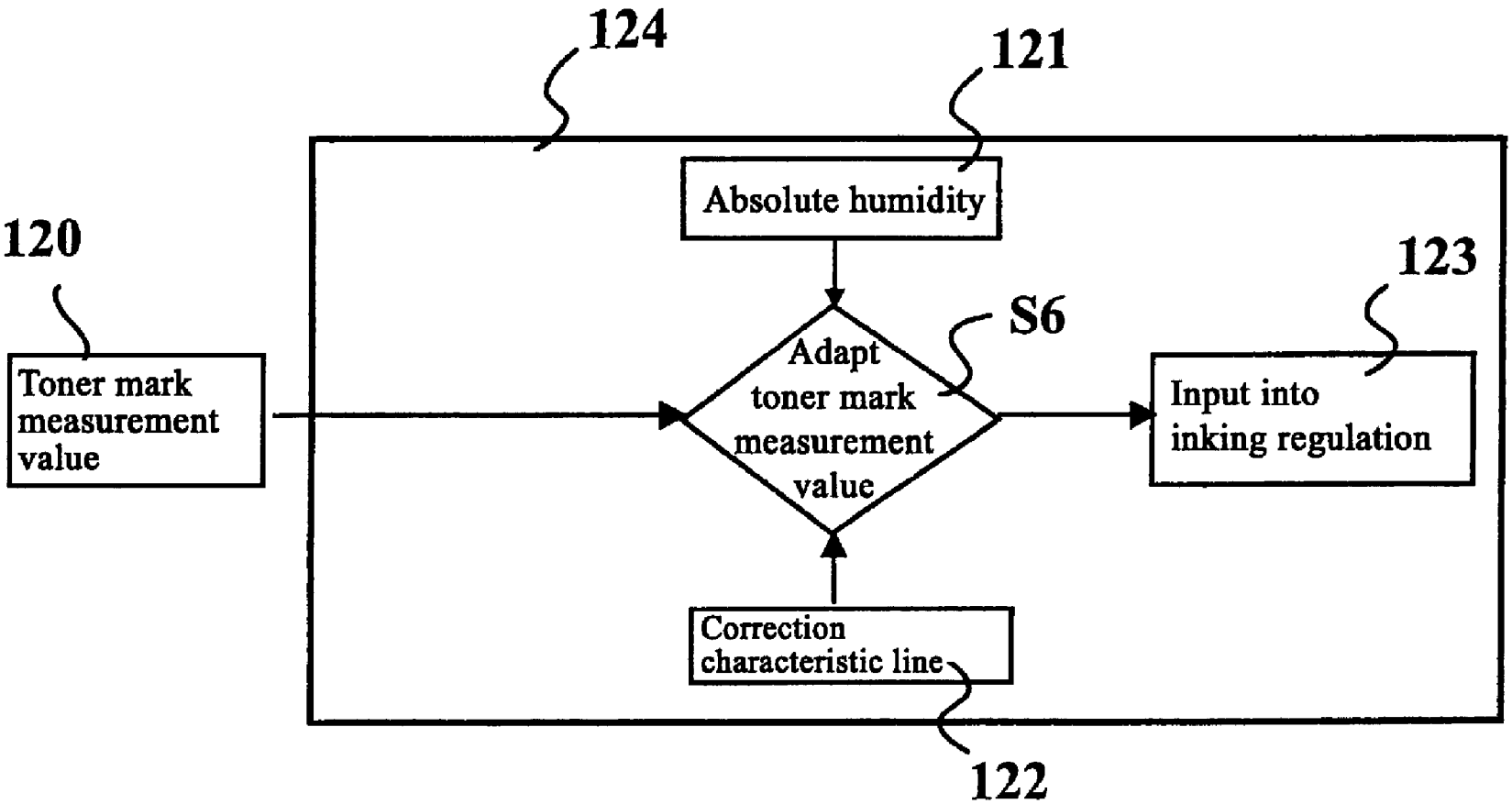
FIG. 6 shows a signal flow for a climate correction.

FIG. 6 shows a principle with which an adapted or corrected toner mark measurement value can be formed and advantageously used. A control component 124 thereby uses on the one hand the toner mark measurement value 120 and on the other hand the value 121 calculated for the absolute humidity in step S5. Using correction values 122, in step S6 the toner mark measurement value is adapted from these or compensated with regard to the absorbed moisture of the toner, and the compensated measurement value 123 is fed into the subsequent inking regulation.

The step S6 can implement (computationally or via corresponding look-up tables) the following adaptation or compensation function for the correction value K:

$$K=a\times e^{b\times H}+c, \text{ whereby}$$

a, b, c are empirical values dependent on the employed toner, e is the Euler number and H is the absolute humidity.

For example, the following values have proven to be suitable for a black test toner: a=−213, b=−0.24 and c=32.

The parameters for other toners can easily be empirically determined from the correlations shown in FIGS. 3 and 4. In order to be able to correspondingly easily adapt the moisture compensation in the measurement arrangement or the controller in the printing device to the most varied toners, the corresponding parameters are stored in the printing device (in particular in the corresponding developer station) such that they can be altered and the respective calculation unit in the evaluation unit or controller is correspondingly designed such that it can be parameterized.

Figure 7:
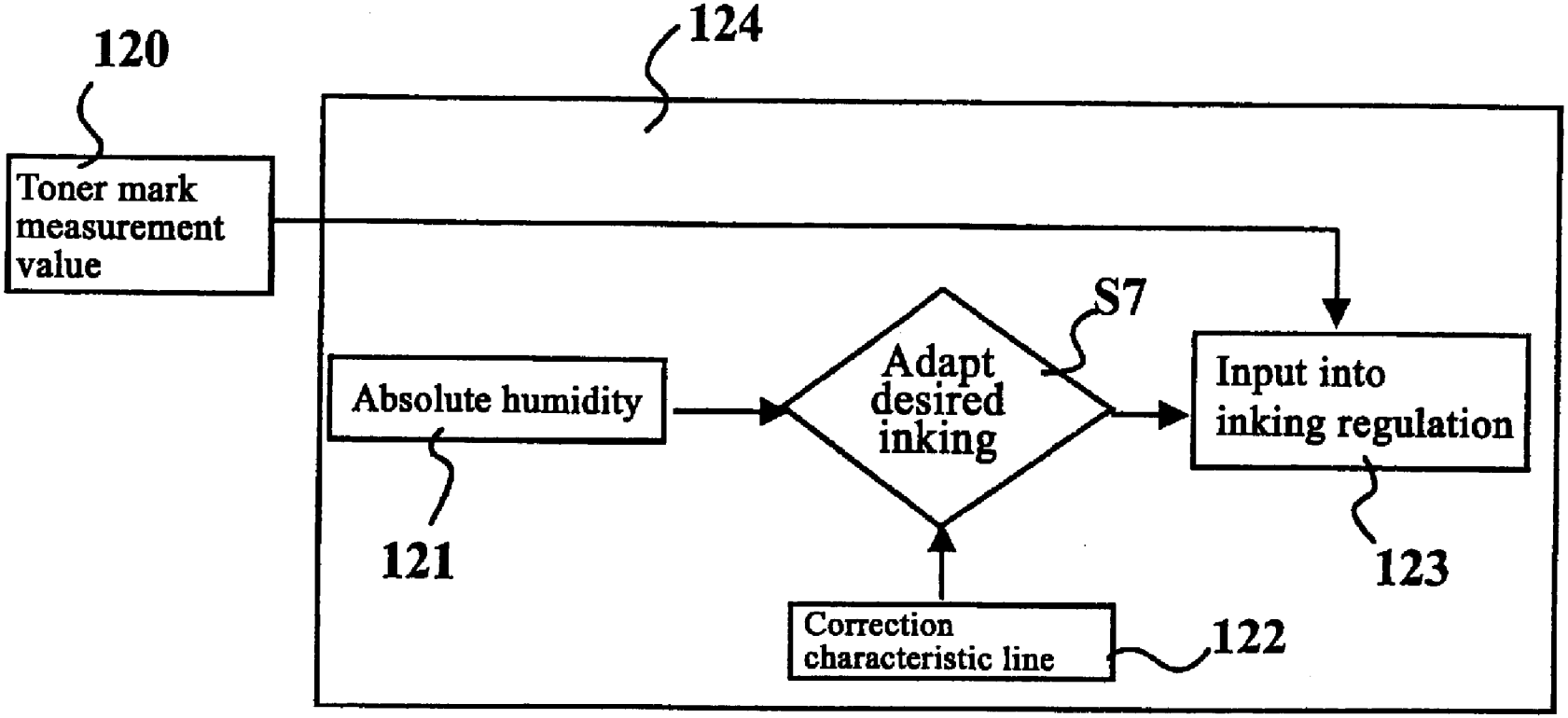
FIG. 7 illustrates a further signal flow for a climate correction.

An exemplary embodiment for measurement value compensation that can be applied in addition to or as an alternative to the embodiment presented in FIG. 6 is shown in FIG. 7. Identical drawing elements are again presented with the same reference characters. In this exemplary embodiment the toner mark measurement value is supplied unchanged to the inking regulation 123. In contrast to this, in a step S7 the input value 121 of the absolute humidity is used in order to calculate a new desired value of the inking regulation 123 with which the inking is regulated. In particular the desired value for the toner concentration in a toner concentration regulation of the developer station can also be provided as such a desired value. The inking regulation can therewith in particular be directly engaged with.

The invention was described using exemplary embodiments. It is thereby clear that the average man skilled in the art can specify suggested developments and modifications. For example, it can be provided to provide moisture sensors in various regions in one and the same printing process or printing device and to empirically or calculationally determine the total water quantity comprised in the toner from the measurement values of the various sensors.

For example, the invention can be used in a printing device that, as described in FIG. 1, is operated with a powdered, dry toner material. However, it can also be used in a printing device that is operated with fluid toner as it is described in, for example, US 2003/0175048 A1.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

I claim as my invention:

1. A method for regulation of optical density in an electrographic printing method, comprising the steps of:

scanning a toner layer thickness of a toner image developed with a developer station with a capacitive sensor and using a resulting toner layer thickness signal for regulation of inking in the developer station;

also measuring relative humidity with a moisture sensor to obtain a relative humidity value;

also measuring temperature with a temperature sensor to obtain a temperature value;

determining an absolute humidity value from said relative humidity value and said temperature value; and using said absolute humidity value for compensation of moisture-dependent deviation of said toner layer thickness signal and/or said regulation of the inking in the developer station.

2. A method according to claim 1 wherein the absolute humidity value is used for regulation of the inking in an inking regulation unit.

3. A method according to claim 1 wherein the relative humidity measurement occurs in a region before a development process and the toner layer thickness measurement occurs in a region after the development process.

4. A method according claim 3 wherein the relative humidity measurement occurs in a region significant for a toner transport and/or a toner stirring.

5. A method according to claim 1 wherein the temperature sensor measures the temperature in a region of a printing process that is significant for toner transport.

6. A method according to claim 1 wherein the temperature sensor and the moisture sensor are designed as a common, combined climate sensor.

7. A method according to claim 1 wherein the developer station is supplied with fluidized toner via an air pressure system that comprises an air inlet valve for fluidization of the toner with air, and wherein the moisture sensor and/or the temperature sensor is arranged in a region of the air inlet valve.

8. A method according to claim 1 wherein a correction value K for the toner layer thickness signal is formed using the absolute humidity value and a corrected toner layer thickness signal is used for the regulation of the inking.

9. A method according to claim 8 wherein the correction value K is determined according to the formula:

$$K=a\times e^{b\times H}+c,$$

where a, b and c are empirical values dependent on the employed toner, and H is the absolute humidity.

10. A method according to claim 1 wherein the humidity value and/or the temperature value is used for activation or regulation of further method components of the printing process.

11. A method according to claim 10 wherein the further method components at the developer station comprise at least one of a corotron voltage, a corotron current, a toner concentration sensor, and a toner concentration regulation.

12. A measurement system for an electrophotographic printer or copier, comprising:

a capacitive sensor which scans a toner layer thickness of a toner image developed with a developer station and creates a toner layer thickness signal connected to a controller for regulation of inking in the developer station;

a moisture sensor which measures relative humidity and creates a relative humidity value;

a temperature sensor which measures temperature and creates a temperature value;

an absolute humidity value determined from the relative humidity value and the temperature value; and a circuit or the controller compensating for moisture-dependent deviations of said toner layer thickness signal by using said absolute humidity value, and/or the controller compensating for moisture-dependent deviations of the toner layer thickness signal by the regulation of the inking in the developer station.

13. A measurement system according to claim 12 wherein the moisture sensor is arranged in a region of the printing device that is significant for the toner transport or a toner stirring.

14. A measurement system according to claim 12 wherein the temperature sensor and the moisture sensor are designed as a common, combined climate sensor.

15. An electrographic printer or copier, comprising:

a photoconductor drum;

a developer station which applies toner on the photoconductor drum; and a measurement system comprising a capacitive sensor which scans a toner layer thickness of a toner image developed with the developer station and creates a toner layer thickness signal connected to a controller for regulation of inking in the developer station, a moisture sensor which measures relative humidity and creates a relative humidity value, a temperature sensor which measures temperature and creates a temperature value, an absolute humidity value determined from the relative humidity value and the temperature value, and a circuit or the controller compensating for moisture-dependent deviations of said toner layer thickness signal by using said absolute humidity value, and/or the controller compensating for moisture-dependent deviations of the toner layer thickness signal by the regulation of the inking in the developer station.

16. A printer or copier according to claim 15 wherein the developer station is supplied with fluidized toner via an air pressure system that comprises an air inlet valve for fluidization of the toner with air, and wherein the moisture sensor and/or the temperature sensor is arranged in a region of the air inlet valve.

* * * * *